US005173965A

United States Patent [19]

Panner

[11] Patent Number: 5,173,965

[45] Date of Patent: Dec. 29, 1992

[54] RELEASABLY ATTACHED TWO SECTION GOWN

[76] Inventor: Donna J. Panner, 8 Van Zant St., #3, Norwalk, Conn. 06855

[21] Appl. No.: 767,663

[22] Filed: Sep. 30, 1991

[51] Int. Cl.[5] ..... A41D 1/22

[52] U.S. Cl. ..... 2/105; 2/74; 2/211; 2/244

[58] Field of Search ..... 2/105, 74, 217, 211, 2/243 R, 269, 244

[56] References Cited

U.S. PATENT DOCUMENTS

| | | | |
|---|---|---|---|
| 583,336 | 9/1866 | Church | 2/211 |
| 698,205 | 4/1902 | Lewis | 2/211 |
| 706,235 | 8/1902 | Hermann | 2/211 |
| 2,724,120 | 11/1955 | Biern | 2/211 |
| 2,899,962 | 8/1959 | Entringer | 2/211 |
| 3,060,466 | 10/1962 | Horne | 2/211 |
| 3,064,265 | 11/1962 | Bridgewaters | 2/105 |
| 3,064,268 | 11/1962 | Nania, Jr. | 2/217 |
| 3,665,516 | 5/1972 | Orovan | 2/74 |
| 3,883,896 | 5/1975 | Cain | 2/74 |
| 4,377,007 | 3/1983 | Sudjian | 2/105 |
| 4,658,443 | 4/1987 | Beman | 2/105 |

FOREIGN PATENT DOCUMENTS

| | | | |
|---|---|---|---|
| 183727 | 8/1922 | United Kingdom | 2/244 |
| 1303149 | 1/1973 | United Kingdom | 2/105 |
| 1378814 | 12/1974 | United Kingdom | 2/105 |

*Primary Examiner*—Werner H. Schroeder
*Assistant Examiner*—Gloria Hale
*Attorney, Agent, or Firm*—CTC & Associates

[57] ABSTRACT

An aggregate floor length gown including an upper section which forms a knee length gown with an ornamental lower border and a lower section with an ornamental upper border, the two sections ornamental borders releasably interconnecting to become an integral part of the gown's design and ornamental appearance.

1 Claim, 3 Drawing Sheets

RELEASABLY ATTACHED TWO SECTION GOWN

BACKGROUND OF THE INVENTION

Floor length ball gowns and floor length bridal gowns have long been worn at weddings, formal receptions and other such occasions. Although these gowns are most attractive for the formal or ceremonial portion of the occasion they invariably become an uncomfortable and possibly dangerous encumbrance to the wearer when the informal portion begins, particularly when dancing is involved. Through the years solutions to this problem have been sought including the wearer draping the rear hemline of the gown over her arm or having a loop sewn into the rear hemline so that the loop could be passed over the wearer's wrist thus supporting the excess fabric off the floor. Still others had duplicate gowns made with long and shorter hemlines, changing into the shorter length gown at the initiation of the informal portion of the occasion. The latter solution being very costly and thus only affordable by a limited portion of the population.

An object of the invention is to provide a simple, temporary means of extending or shortening the length of a dress or gown.

Another object of the invention is to provide a low cost, temporary means of extending or shortening the length of a dress or gown.

Another object of the invention is to provide an ornamental means of temporarily changing the hemline and style of hemline of a dress or gown.

Another object of the invention is to provide a simple low cost means of temporarily changing the appearance of a dress or gown.

PRIOR AR

A preliminary search effected at the U.S. Patent and Trademark public search room revealed the following art:

| U.S. Pat. No. | Date | Inventor |
|---|---|---|
| 2,724,120 | November 22, 1955 | Biern |
| 3,064,268 | November 20, 1962 | Nania, Jr. |
| 3,665,516 | May 20, 1972 | Orovan |
| 3,883,896 | May 20, 1975 | Cain |
| 4,377,007 | March 22, 1983 | Sudjian |

In general the prior art deals with means of tucking under excess skirt length and means for holding the tuck (Nania Jr., Orovan, Cain). Another approach is a two piece dress one piece of which is longer than the other. Either piece can be worn independently or one can be worn over the other (Sudjian).

The only patent that deals with removing a length of the skirt does so in a permanent manner by pulling out a draw thread at the desired length (Biern).

In addition to the above art, attention is drawn to pages 152 through and including page 175 of the Fall & Winter 1990, J.C. PENNEY CATALOG wherein only one gown of the forty five that are illustrated (page 155 "A") indicates a detachable train and that fastens on the outside at the hip or waist thus does not become an integral part of the gown which remains a floor length sheath.

SUMMARY OF THE INVENTION

The invention disclosed herein concerns itself with gowns formed by an aggregate of two sections. The first upper section a shorter length gown which may be worn independently and a second lower section which increases the gown's length and changes its appearance. The two sections are releasably fastenable at the hemline of the first upper shorter length in such a manner that the junction of the two sections adds to the ornamental appearance of the full gown. Similarly, the invention can easily be used to change the length or appearance of skirts or dresses by changing the hemline of the same from knee length to tea length or floor length and the style of the hemline from straight to tulip, handkerchief or high low.

The complete garment formed in this invention by the aggregate of the two sections is composed of an upper first section which usually includes in descending order a neckline, bodice, waistline and skirt. The hemline of the upper section has incorporated into it a ornamental border which includes or hides one part of a two part releasably fastenable system. The upper hem of the second or lower of two sections has an ornamental border located somewhat below its upper hem. This border may incorporate the second part of the two part releasably fastenable system or alternatively may hide or obscure the second part of the two part releasably fastenable system.

When the first upper and second lower sections are joined the upper hem of the second lower section underlaps the first or upper section to protect and shield the wearer and add to the overall appearance of the garment. The ornamental border at the hemline of the upper or first section is incorporated into and adds to its appearance when worn independently and does not require the joining of the second ornamental border to do so.

Further modification of the skirt portion of a gown may be readily accomplished by using different fabrics for the upper first section and lower second section. Examples being satin, taffeta, velvet or tapestry upper first sections and georgette or lace lower sections or any reasonable combinations of fabric for either section. Similarly varying compatible colors might be used for the upper and lower sections.

DETAILED DESCRIPTION OF THE INVENTION

Figure 1:
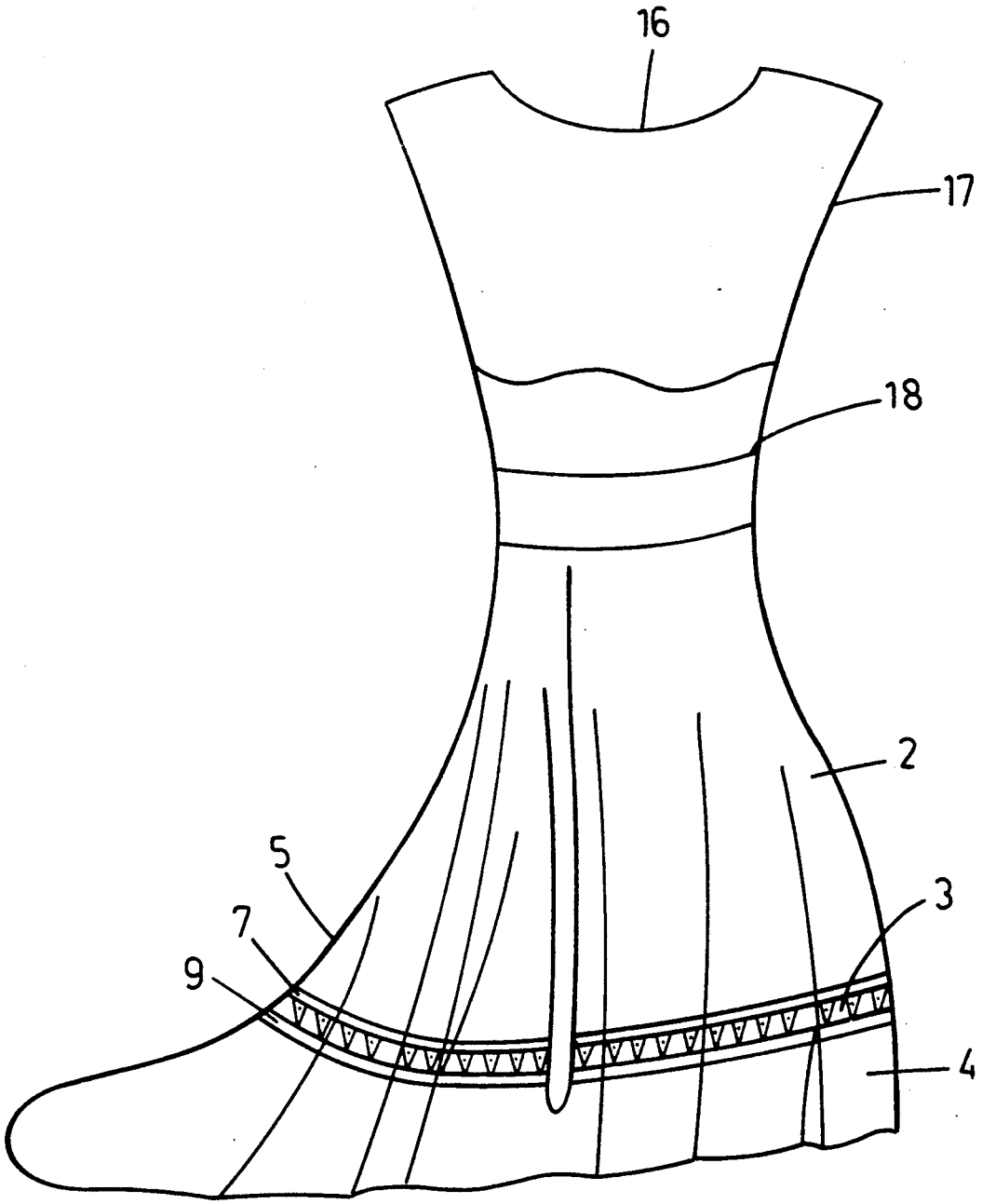
FIG. 1 illustrates the joined first and second sections of a gown with a full floor length gown and train and the ornamental design formed by the joining of the two ornamental borders.
Figure 2:
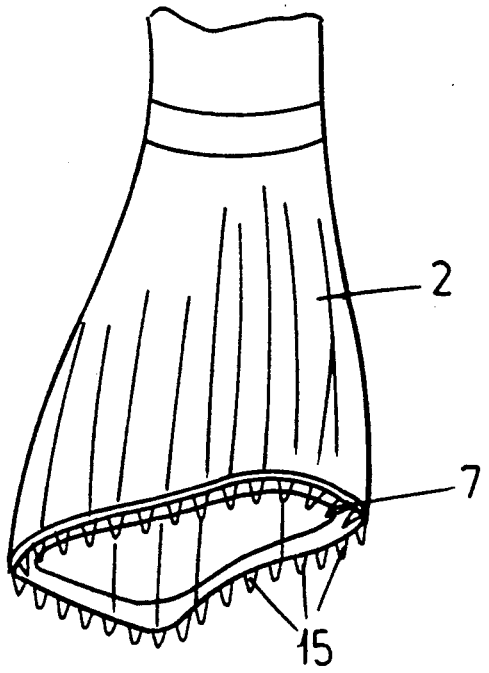
FIG. 2 shows the skirt portion of the two sections of a high low, intermezzo length gown.
Figure 3:
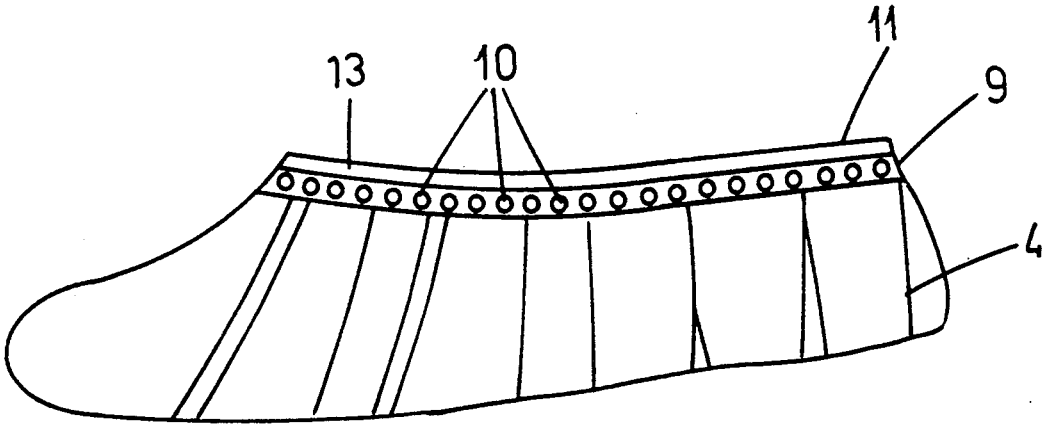
FIG. 3 shows the second or lower portion of the two sections.
Figure 4:
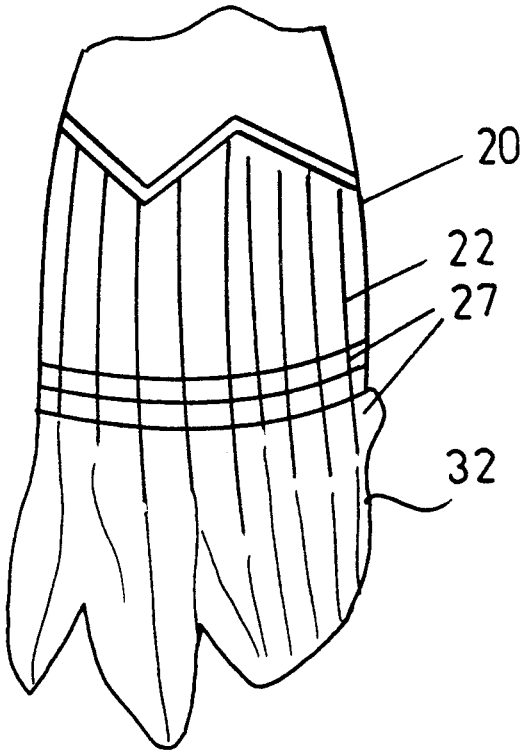
FIG. 4 shows a handkerchief type of ankle length gown extending form the wearer's waistline and is made up of the joined upper and lower sections.
Figure 5:
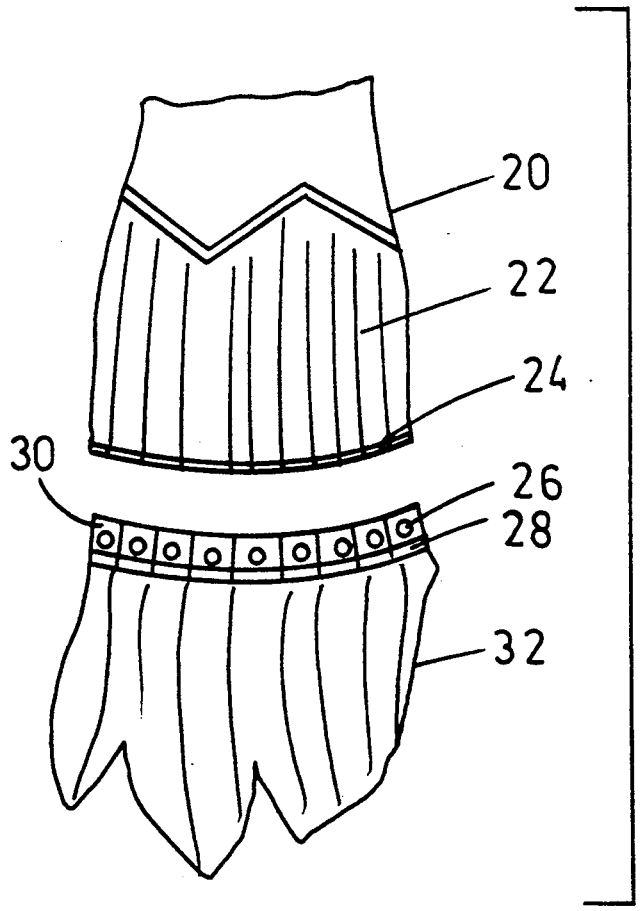
FIG. 5 illustrates the two separated sections of the ankle length skirt. The first section having a straight hemline just below the knee line (day length) hemline. The second a handkerchief type ankle length hemline which when joined form the complete gown of FIG. 4.

Floor length skirt of a complete gown with a train 5 (FIG. 1) is composed of an upper first section 2 and a lower second section 4. The upper first section 2 which includes in descending order a neckline 16 a bodice 17 waistline 18 and skirt 5. An ornamental part of the design 3 is formed by border 7 and affixed to the hemline of the upper first section 2 forming the hemline of a complete wearable shorter length gown. The ornamental border extends around the complete hemline and incorporates the first of a two component releasable fastenable means which as illustrated is made up of continuous strips of loop braid affixed to upper first section 7. Lower section skirt section 4 has crystal beads or buttons 10 affixed immediately below its upper hem 11 forming an ornamental border. The distance below hemline 11 where crystal beads or buttons are affixed is such that a minimum underlap 13 (not shown) beneath upper first section of 1 inch (2.54 cm) is formed to shield the wearer from contact with the joined ornamental interlocking upper and lower borders. The affixed crystal beads or buttons being so located as to be able to be readily interlocked and releasably fastened to loops 15 in the upper first section. Alternatively the releasable fastening means (FIGS. 4 and 5) may be the well known male, female snaps (female portion not shown) wherein the female portion of the snap is affixed to the underside of the dress fabric underneath the decorative border of the upper first section and the male portion of the snap is affixed somewhat below the upper hem of the lower section on the outer surface of the fabric and above the decorative border. The joining being accomplished by interlocking appropriately located male and female snaps on the outside of lower section 32 and underside of upper section 20. Other two component releasable fastening means such as hook and loop fabric, hook and eye fasteners, zippers and the like could also be conveniently incorporated into the instant invention.

Combined ornamental design 27 formed by interlocking the upper and lower sections may be affixed braid or lace of similar or contrasting colors or may be made from the dress fabric itself by sewing an ornamental design into the hemline of the upper portion and immediately below the upper hem 28 of lower portion 32. Examples of such ornamental design which may be sewn into the dress fabric of the upper and lower portions might be but are not limited to the well known but not shown rib trim, ruffles, fluted or lettuce edges.

It should be understood that changes and or modifications in the form, arrangement and combinations of the ornamental components of the invention may be made and substituted for those described herein without departing from the principle of the invention shown herein. Reference should be made to the appended claims rather than the foregoing specification to determine the scope of the invention.

What is claimed is:

1. An aggregate ornamental floor length gown comprising separatable upper and lower sections, said upper section includes in descending order a neckline, bodice, waistline and skirt which forms a knee length gown, said skirt having a lower hemline incorporating the first of an ornamental two component releasable fastening means, said first component being a continuous length of loop braid, said loops extending below said upper section's lower hemline forming an ornamental border for such knee length gown; said lower section of said aggregate ornamental floor length gown having an upper hemline with an ornamental border located at least 1 inch (2.5 cm) below said hemline, said ornamental border forming the second component of said two component releasable fastening means, said second component being made up of a row of crystal buttons extending circumferentially around said lower section, said crystal buttons being located so as to releasably interconnect with said loops of said upper section; said upper hemline of said lower section being placed beneath said upper section's ornamental border to conceal the joint formed by the joining and interconnecting of said upper and lower sections, said joined upper and lower sections ornamental borders acting in concert to form an integral part of said floor length gown's appearance.

* * * * *